US006984112B2

(12) United States Patent
Zhang et al.

(10) Patent No.: US 6,984,112 B2
(45) Date of Patent: Jan. 10, 2006

(54) METHODS AND APPARATUS FOR COOLING GAS TURBINE ROTOR BLADES

(75) Inventors: Xiuzhang James Zhang, Simpsonville, SC (US); Olivier Muller, Danjoutin (FR); Tahar Bouktir, Belfort (FR)

(73) Assignee: General Electric Company, Schenectady, NY (US)

( * ) Notice: Subject to any disclaimer, the term of this patent is extended or adjusted under 35 U.S.C. 154(b) by 96 days.

(21) Appl. No.: 10/699,056

(22) Filed: Oct. 31, 2003

(65) Prior Publication Data

US 2005/0095134 A1 May 5, 2005

(51) Int. Cl.
*F01D 25/12* (2006.01)

(52) U.S. Cl. ..... 416/193 A

(58) Field of Classification Search ..... 416/95, 416/97 R, 193 A, 239; 415/115
See application file for complete search history.

(56) References Cited

U.S. PATENT DOCUMENTS

| | | | | |
|---|---|---|---|---|
| 3,369,792 A | | 2/1968 | Kraimer et al. | |
| 4,236,870 A | | 12/1980 | Hucul, Jr. et al. | |
| 4,589,824 A | | 5/1986 | Kozlin | |
| 4,726,104 A | | 2/1988 | Foster et al. | |
| 5,215,431 A | | 6/1993 | Derrien | |
| 5,261,789 A | | 11/1993 | Butts et al. | |
| 5,342,172 A | | 8/1994 | Coudray et al. | |
| 5,503,527 A | | 4/1996 | Lee et al. | |
| 5,503,529 A | | 4/1996 | Anselmi et al. | |
| 5,669,759 A | | 9/1997 | Beabout | |
| 5,772,397 A | | 6/1998 | Morris et al. | |
| 5,772,398 A | | 6/1998 | Noiret et al. | |
| 5,947,687 A | * | 9/1999 | Mori et al. | 416/193 A |
| 6,164,914 A | | 12/2000 | Correia et al. | |
| 6,174,135 B1 | | 1/2001 | Lee | |
| 6,179,556 B1 | | 1/2001 | Bunker | |
| 6,299,412 B1 | | 10/2001 | Wood et al. | |
| 6,382,913 B1 | | 5/2002 | Lee et al. | |
| 6,390,775 B1 | * | 5/2002 | Paz | 416/193 A |

FOREIGN PATENT DOCUMENTS

| | | |
|---|---|---|
| EP | 0801208 A2 | 10/1997 |
| EP | 1101898 A3 | 1/2004 |
| GB | 1190771 | 4/1996 |
| JP | 01063605 A | 3/1989 |

* cited by examiner

*Primary Examiner*—Ninh H. Nguyen
(74) *Attorney, Agent, or Firm*—Armstrong Teasdale LLP

(57) ABSTRACT

A turbine blade is provided. The turbine blade includes a blade platform having an airfoil portion and a root portion extending therefrom, an undercut formed in a first side of the platform and a purge slot formed in a second side of the platform.

28 Claims, 5 Drawing Sheets

METHODS AND APPARATUS FOR COOLING GAS TURBINE ROTOR BLADES

BACKGROUND OF THE INVENTION

This application relates generally to gas turbine engines and, more particularly, to methods and apparatus for cooling gas turbine engine rotor assemblies.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

During operation, because the airfoil portions of the blades are exposed to higher temperatures than the dovetail portions, temperature mismatches may develop at the interface between the airfoil and the platform, and/or between the shank and the platform. Over time, such temperature differences and thermal strain may induce large compressive thermal stresses to the blade platform. In addition, if the blade platform generally is fabricated with a greater stiffness than the airfoil, such thermal strains may also induce thermal deformations to the airfoil, as the airfoil is displaced in response to the stresses induced to the shank and platform. Moreover, over time, the increased operating temperature of the platform may cause platform oxidation, platform cracking, and/or platform creep deflection, which may shorten the useful life of the rotor blade.

To facilitate reducing the effects of the high temperatures, within at least some known rotor blades, at least one of the pressure side and/or suction sides of the platform is formed with a recessed slot which facilitates channeling airflow from a shank cavity defined between adjacent rotor blades for use in cooling the platform trailing edge of an adjacent circumferentially-spaced rotor blade. Although such slots do facilitate reducing an operating temperature of an adjacent rotor blade platform trailing edge, such slots may induce stresses into the rotor blade in which they are formed.

BRIEF DESCRIPTION OF THE INVENTION

In one aspect, a method for fabricating a rotor blade for a gas turbine engine is provided. The method comprises providing a rotor blade that includes an airfoil, a platform, a shank, and a dovetail, wherein the shank extends between the platform and the dovetail, and wherein the platform extends between the airfoil and the shank, wherein the platform includes a leading edge side and a trailing edge side connected together by a pair of opposing sidewalls. The method also comprises forming an undercut in a portion of the platform to facilitate cooling the trailing edge side of the platform during operation, and forming a purge slot in a portion of the platform to facilitate channeling downstream towards the platform trailing edge side.

In another aspect, a rotor blade for a gas turbine is provided. The rotor blade includes a platform, an airfoil, a shank, and a dovetail. The platform includes a radially outer surface and a radially inner surface. The platform radially inner surface includes an undercut and a purge slot formed therein. The purge slot is for channeling cooling air downstream therefrom. The undercut facilitates cooling a portion of the platform during engine operation. The airfoil extends radially from the platform radially outer surface. The shank extends radially from the platform radially inner surface, and the dovetail extends from the shank for coupling the rotor blade within the gas turbine engine.

In a further aspect, a rotor assembly for a gas turbine engine is provided. The rotor assembly includes a rotor shaft and a plurality of circumferentially-spaced rotor blades that are coupled to the rotor shaft. Each of the rotor blades includes an airfoil, a platform, a shank, and a dovetail. The airfoil extends radially outward from the platform, and the platform includes a radially outer surface and a radially inner surface. The shank extends radially inward from the platform, and the dovetail extends from the shank for coupling each rotor blade to the rotor shaft. At least a first of the rotor blades includes an undercut and a purge slot defined within a portion of the first rotor blade platform. The undercut facilitates cooling the platform, and the purge slot facilitates channeling air downstream past the shank.

DETAILED DESCRIPTION OF THE INVENTION

Figure 1:
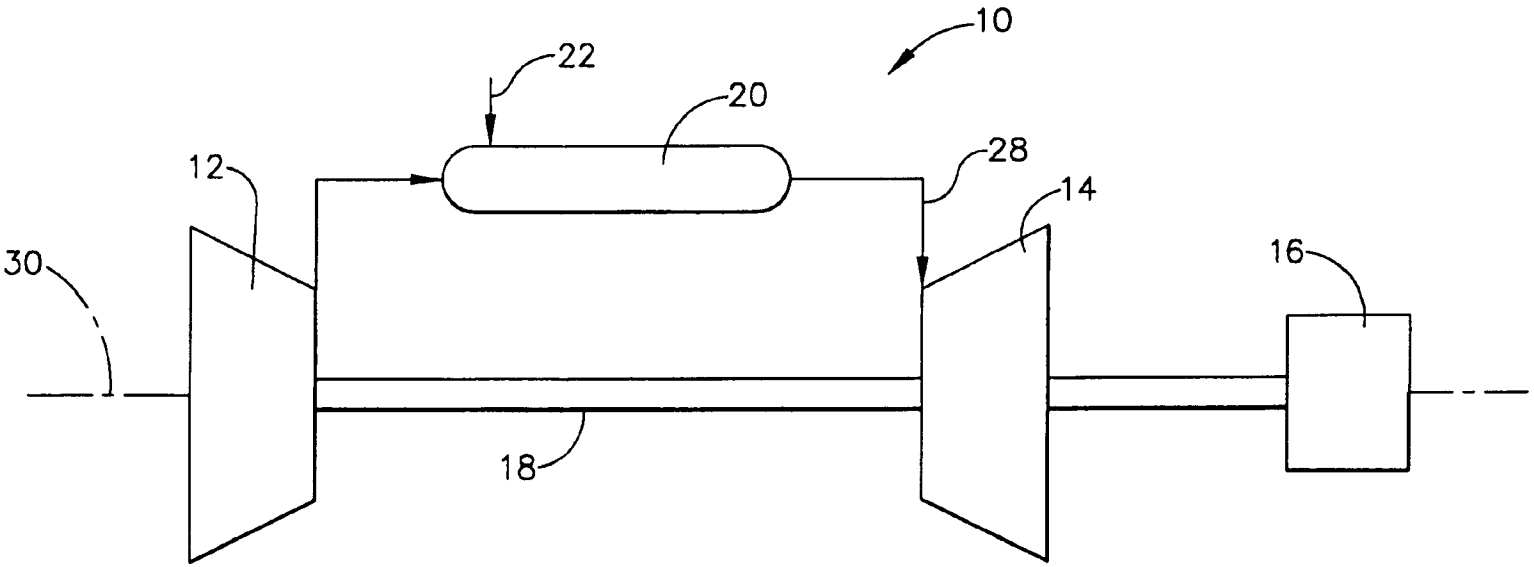
FIG. 1 is a schematic illustration of an exemplary gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel supplied via a stream 22. In one embodiment, engine 10 is a 6FA+e gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
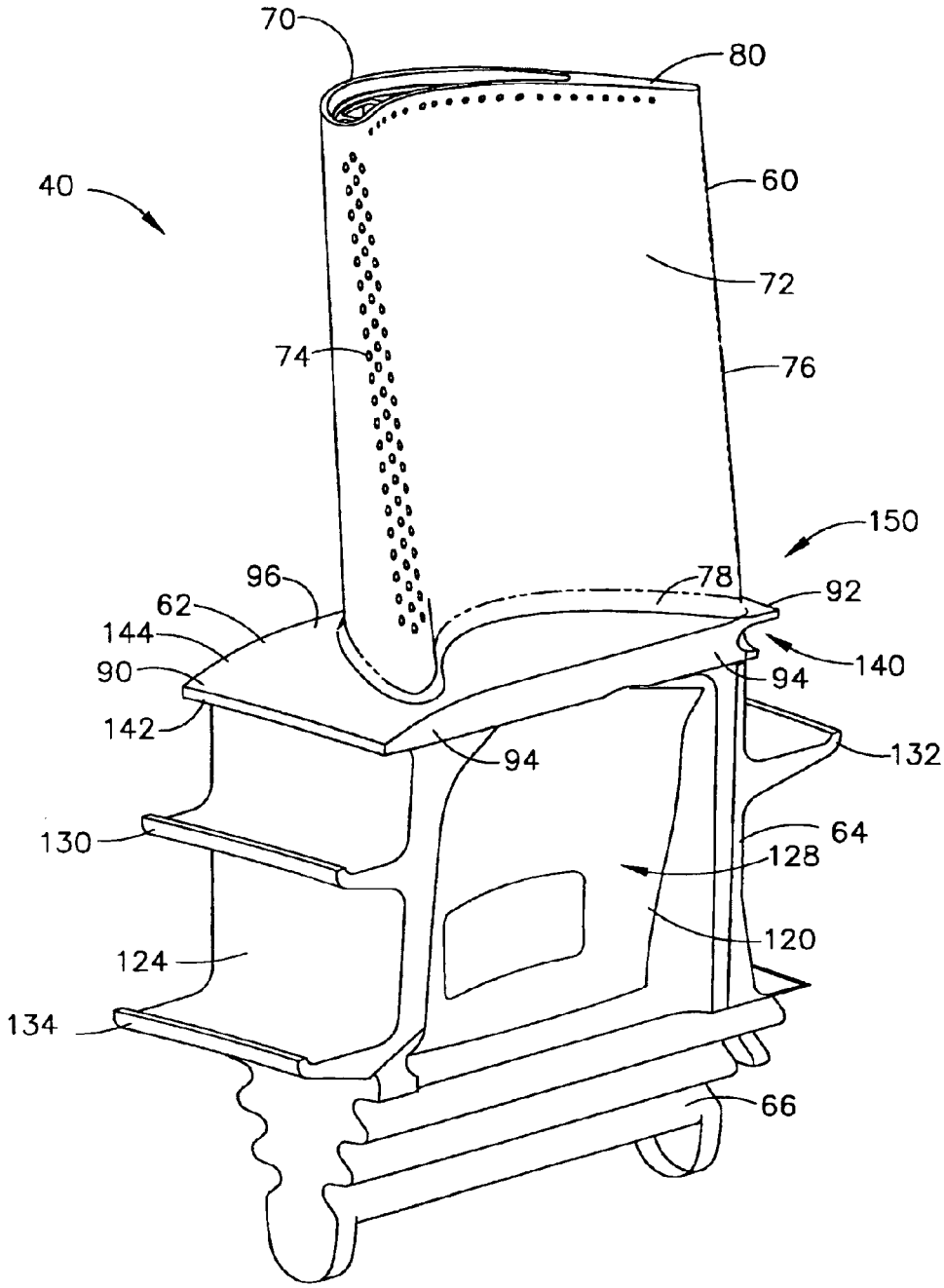
FIG. 2 is a perspective view of an exemplary rotor blade that may be used with the gas turbine engine shown in FIG. 1.
Figure 3:
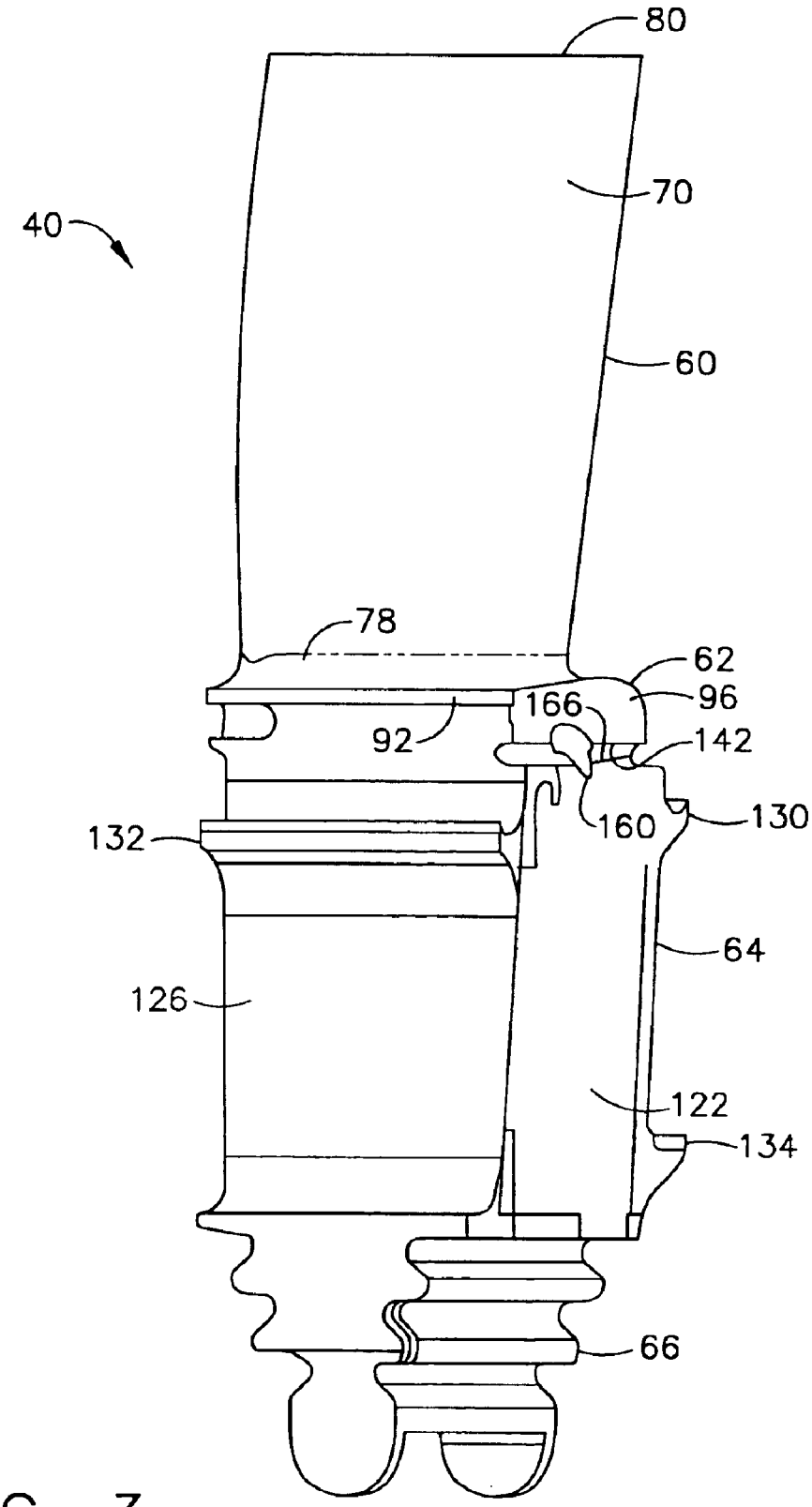
FIG. 3 is a perspective view of the rotor blade shown in FIG. 2 and viewed from an opposite end of the rotor blade.
Figure 4:
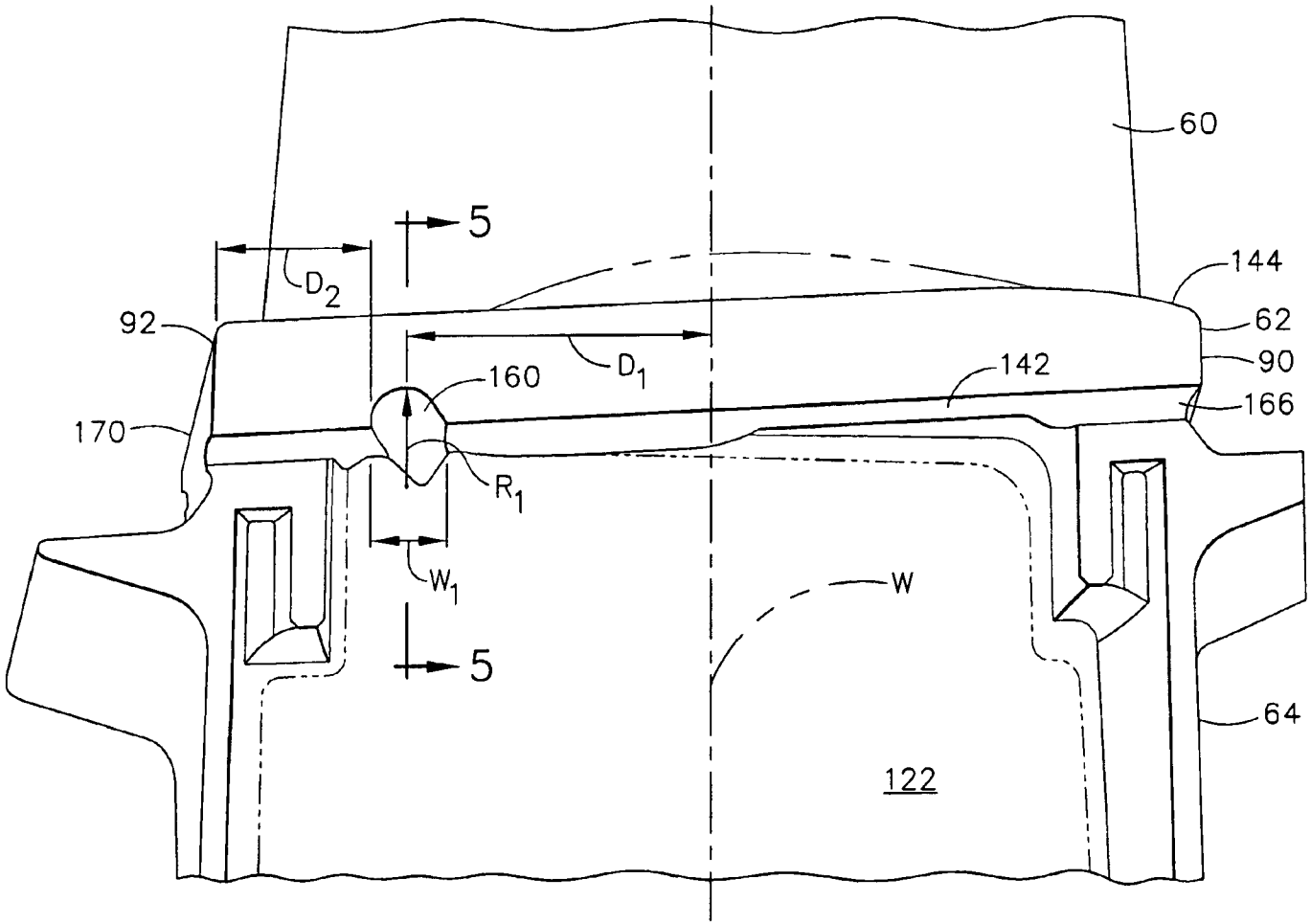
FIG. 4 is a side view of a portion of the rotor blade shown in FIG. 3.
Figure 5:
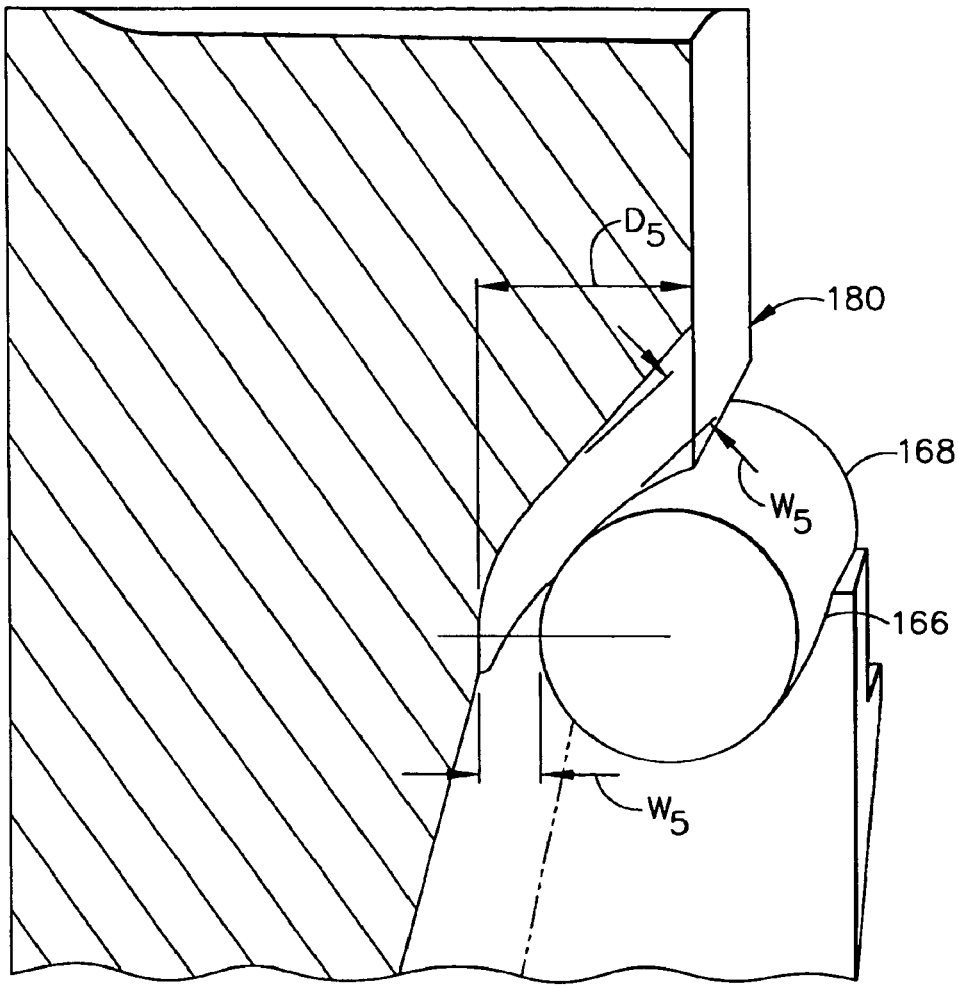
FIG. 5 is a cross-sectional view of a portion of the rotor blade shown in FIG. 4 taken along line 5—5.

FIGS. 2 and 3 are each perspective views of an exemplary rotor blade 40 that may be used with gas turbine engine 10 (shown in FIG. 1). And viewed from an opposite sides of blade 40. FIG. 4 is a side view of a portion of rotor blade 40, and FIG. 5 is a cross-sectional view of a portion of rotor blade 40 taken along line 5—5. When blades 40 are coupled within a rotor assembly, such as turbine 14 (shown in FIG. 1), each rotor blade 40 is coupled to a rotor disk (not shown) that is rotatably coupled to a rotor shaft, such as shaft 18 (shown in FIG. 1). In an alternative embodiment, blades 40 are mounted within a rotor spool (not shown). In the exemplary embodiment, blades 40 are identical and each extends radially outward from the rotor disk and includes an airfoil 60, a platform 62, a shank 64, and a dovetail 66. In the exemplary embodiment, airfoil 60, platform 62, shank 64, and dovetail 66 are collectively known as a bucket.

Each airfoil 60 includes first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber (not shown) defined within blade 40. More specifically, the internal cooling chamber is bounded within airfoil 60 between sidewalls 70 and 72, and extends through platform 62 and through shank 64 and into dovetail 66.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 40 and 44 to the rotor disk. Platform 62 also includes an upstream side or skirt 90 and a downstream side or skirt 92 which are connected together with a pressure-side edge 94 and an opposite suction-side edge 96.

Shank 64 includes a substantially concave sidewall 120 and a substantially convex sidewall 122 connected together at an upstream sidewall 124 and a downstream sidewall 126 of shank 64. Accordingly, shank sidewall 120 is recessed with respect to upstream and downstream sidewalls 124 and 126, respectively, such that when buckets 40 are coupled within the rotor assembly, a shank cavity 128 is defined between adjacent rotor blade shanks 64.

In the exemplary embodiment, a forward angel wing 130 and an aft angel wing 132 each extend outwardly from respective shank sides 90 and 92 to facilitate sealing forward and aft angel wing buffer cavities (not shown) defined within the rotor assembly. In addition, a forward coverplate 134 also extends outwardly from respective shank sides 124 and 126 to facilitate sealing between buckets 40 and the rotor disk. More specifically, coverplate 134 extends outwardly from shank 64 between dovetail 66 and forward angel wing 130.

In the exemplary embodiment, a platform undercut or trailing edge recessed portion 140 is defined within platform 62. Specifically, platform undercut 140 is defined within platform 62 between a platform radially inner surface 142 and a platform radially outer surface 144. More specifically, platform undercut 140 is defined within platform downstream skirt 92 at an interface 150 defined between platform pressure-side edge 94 and platform downstream skirt 92. Accordingly, when adjacent rotor blades 40 are coupled within the rotor assembly, undercut 140 facilitates improving trailing edge cooling of platform 62 such that the low cycle fatigue life of blade 40 is improved.

Platform 62 also includes a recessed portion or purge slot 160. More specifically, slot 160 is only defined within platform radially inner surface 142 along platform suction-side edge 96 between shank upstream and downstream sidewalls 124 and 126. Moreover, a channel 166 is formed adjacent slot 160 for receiving a damper pin 168 therein when each rotor blade 40 is coupled within the rotor assembly.

Purge slot 160, as described in more detail below, facilitates channeling cooling air from shank cavity 128 to facilitate increasing an amount of cooling air supplied to an undercut 140 formed on a circumferentially-adjacent rotor blade 40.

An overall size, shape, and location of slot 160 with respect to blade 40 varies depending on flow requirements necessary to ensure adequate cooling flow to platform undercut 140. A relative location of purge slot 160 is empirically determined relative to a datum W and to an aft surface 170 of downstream skirt 92. More specifically, in the exemplary embodiment, purge slot 160 is a distance $D_1$ aft of a datum W and a distance $D_2$ upstream from skirt surface 170. In the exemplary embodiment, distance $D_1$ is approximately 0.765 inches and distance $D_2$ is approximately 0.48 inches.

A relative size and shape of purge slot 160 is also empirically determined to facilitate optimizing cooling air flow to trailing edge undercut 140. In the exemplary embodiment, purge slot 160 has a substantially elliptically-shaped cross-sectional area and is formed with a predetermined radius of curvature $R_1$ such that purge slot 160 has a width $W_1$. In an alternative embodiment, purge slot 160 has a non-elliptically shaped cross-sectional area. More specifically, in the exemplary embodiment, purge slot 52 radius of curvature $R_1$ is approximately equal to 0.145 inches, and purge slot width $W_1$ is approximately equal 0.265 inches.

Furthermore, purge slot 160 is formed with a depth $D_3$ measured with respect to platform side 94 that facilitates ensuring an adequate amount of cooling air is channeled past damper pin 168 when blade 40 is coupled within the rotor assembly. In the exemplary embodiment, depth $D_3$ is approximately equal to 0.169 inches. As is known in the art, damper pins 168 are inserted within channel 166 to facilitate coupling adjacent rotor blades 40 together. More specifically, when damper pin 168 is inserted within groove 166, purge slot 160 is such that a flow gap 180 is defined between slot 160 and damper pin 168. In one embodiment, gap 180 has a width $W_5$ that is at least approximately equal 0.051 inches wide to enable cooling air to enter purge slot 160 and be channeled around damper pin 168.

During operation, wheel space cooling flow enters a first rotor blade shank cavity 128 and is channeled around damper pin 166 and discharged from purge slot 160 to facilitate increasing cooling flow to undercut 140 facilitates reducing an operating temperature of platform 62 and also reducing thermal stresses induced to blade 40. In addition, the enhanced cooling also facilitates increasing the fatigue capability of blade 40.

In addition, the combination of purge slot 160 and undercut 140 facilitates preventing crack initiation within platform 62 or between platform 62 and airfoil 60. Accordingly, when adjacent rotor blades 40 are coupled within the rotor assembly, the combination of undercut 140 and purge slot 160 facilitates improving trailing edge cooling of platform 62 such that the low cycle fatigue life of blade 40 is improved. Moreover, because undercut 140 extends through the load path of blade 40, mechanical stresses induced to platform downstream skirt 92 are also facilitated to be reduced, thus extending the useful life of rotor blade 40.

The above-described rotor blades provide a cost-effective and highly reliable method for supplying cooling air to facilitate reducing an operating temperature of the rotor blade platform. More specifically, the purge slot facilitates ensuring an adequate flow of cooling air is channeled to the trailing edge platform undercut, such that the operating temperature of the platform is facilitated to be reduced. Accordingly, platform oxidation, platform cracking, and platform creep deflection is also facilitated to be reduced. As a result, the platform purge slot facilitates extending a useful life of the rotor assembly and improving the operating efficiency of the gas turbine engine in a cost-effective and reliable manner.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade component can also be used in combination with other rotor blades, and is not limited to practice with only rotor blade 40 as described herein. Rather, the present invention can be implemented and utilized in connection with many other blade cooling configurations.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine, said method comprising:

providing a rotor blade that includes an airfoil, a platform, a shank, and a dovetail, wherein the shank extends between the platform and the dovetail, and wherein the platform extends between the airfoil and the shank, wherein the platform includes a leading edge side and a trailing edge side connected together by a pair of opposing sidewalls;

forming an undercut in a portion of the platform to facilitate cooling the trailing edge side of the platform during operation; and forming a purge slot in a portion of the platform to facilitate channeling downstream towards the platform trailing edge side.

2. A method in accordance with claim 1 wherein said forming a purge slot in a portion of the platform further comprises forming the purge slot with a substantially elliptical cross-sectional profile.

3. A method in accordance with claim 1 wherein said forming a purge slot in a portion of the platform further comprises further comprises forming the purge slot with a radius of curvature.

4. A method in accordance with claim 1 wherein the platform includes a radially inner surface and a radially outer surface, said forming a purge slot in a portion of the platform further comprises forming the purge slot within a portion of the platform radially inner surface.

5. A method in accordance with claim 4 wherein said forming an undercut in a portion of the platform further comprises forming the undercut between the platform radially inner and outer surfaces.

6. A method in accordance with claim 1 wherein the platform comprises a pressure side and a suction side, said forming an undercut in a portion of the platform further comprises forming the undercut in a portion of the platform along the pressure side of the platform.

7. A method in accordance with claim 1 wherein the platform comprises a pressure side and a suction side, said forming a purge slot in a portion of the platform further comprises forming the purge slot in a portion of the platform suction side.

8. A method in accordance with claim 1 wherein the platform comprises a pressure side and a suction side, said forming a purge slot in a portion of the platform further comprises forming the purge slot in a portion of the platform of a first rotor blade to facilitate channeling cooling air towards an undercut formed in a circumferentially-spaced second rotor blade.

9. A rotor blade for a gas turbine, said rotor blade comprising:

a platform comprising a radially outer surface and a radially inner surface, said platform radially inner surface comprising an undercut and a purge slot formed therein, said purge slot for channeling cooling air downstream therefrom, said undercut facilitates cooling a portion of said platform during engine operation;

an airfoil extending radially from said platform radially outer surface;

a shank extending radially from said platform radially inner surface; and a dovetail extending from said shank for coupling said rotor blade within the gas turbine engine.

10. A rotor blade in accordance with claim 9 wherein said purge slot is formed with a substantially elliptical cross-sectional profile.

11. A rotor blade in accordance with claim 9 wherein said purge slot is formed with a radius of curvature.

12. A rotor blade in accordance with claim 9 wherein said platform further comprises a leading edge side and a trailing edge side connected together by a pair of opposing sidewalls, said purge slot formed within at least one of said platform sidewalls between said platform leading and trailing sides.

13. A rotor blade in accordance with claim 9 wherein said platform further comprises a suction side and a pressure side, said purge slot formed within a portion of said platform suction side.

14. A rotor blade in accordance with claim 9 wherein said platform further comprises a suction side and a pressure side, said platform undercut formed within a portion of said platform pressure side.

15. A rotor blade in accordance with claim 9 wherein said platform purge slot is configured to channel cooling air downstream from a shank cavity defined between a pair of circumferentially-spaced said rotor blades.

16. A rotor blade in accordance with claim 9 wherein said rotor blade is configured to be coupled within a rotor assembly including a plurality of other rotor blades, said platform purge slot is configured to channel cooling air downstream towards an undercut formed within at least one of the other circumferentially-spaced rotor blades.

17. A rotor blade in accordance with claim 9 wherein said platform purge slot is defined within said platform radially inner surface.

18. A rotor blade in accordance with claim 9 wherein said platform undercut is formed between said platform radially inner and outer surfaces.

19. A rotor assembly for a gas turbine engine, said rotor assembly comprising:

a rotor shaft; and a plurality of circumferentially-spaced rotor blades coupled to said rotor shaft, each of said rotor blades comprises an airfoil, a platform, a shank, and a dovetail, said airfoil extends radially outward from said platform, said platform comprises a radially outer surface and a radially inner surface, said shank extends radially inward from said platform, said dovetail extends from said shank for coupling said rotor blade to said rotor shaft, at least a first of said rotor blades comprising an undercut and a purge slot defined within a portion of said first rotor blade platform, said undercut facilitates cooling said platform, said purge slot facilitates channeling air downstream past said shank.

20. A rotor assembly in accordance with claim 19 wherein each said rotor blade platform comprises a leading edge side and a trailing edge side coupled together by a suction-side sidewall and a pressure-side sidewall, said purge slot formed within at least one of said suction-side sidewall and said pressure-side sidewall.

21. A rotor assembly in accordance with claim 20 wherein said first rotor blade platform purge slot is formed within a portion of said platform suction-side sidewall.

22. A rotor assembly in accordance with claim 20 wherein said first rotor blade platform undercut is formed within a portion of said platform pressure-side sidewall.

23. A rotor assembly in accordance with claim 20 wherein said first rotor blade purge slot has a substantially elliptical cross-sectional profile.

24. A rotor assembly in accordance with claim 20 wherein said first rotor blade purge slot comprises a radius of curvature.

25. A rotor assembly in accordance with claim 20 wherein said first rotor blade platform purge slot is configured to channel cooling air downstream from a shank cavity defined between said first rotor blade and a circumferentially adjacent second rotor blade.

26. A rotor assembly in accordance with claim 25 wherein said first rotor blade platform purge slot is configured to channel cooling air downstream towards an undercut formed within said second rotor blade.

27. A rotor assembly in accordance with claim 20 wherein said first rotor blade platform purge slot is only defined within said first rotor blade platform radially inner surface.

28. A rotor assembly in accordance with claim 20 wherein said first rotor blade platform undercut is formed between said first rotor blade platform radially inner and outer surfaces.

* * * * *